US009545544B2

(12) United States Patent
Jones et al.

(10) Patent No.: US 9,545,544 B2
(45) Date of Patent: Jan. 17, 2017

(54) GOLF CLUBS WITH ADJUSTABLE LIE AND LOFT AND METHODS OF MANUFACTURING GOLF CLUBS WITH ADJUSTABLE LIE AND LOFT

(71) Applicant: KARSTEN MANUFACTURING CORPORATION, Phoenix, AZ (US)

(72) Inventors: Chris L. Jones, Buckeye, AZ (US); John P. Fife, Phoenix, AZ (US); Erik M. Henrikson, Mesa, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 14/138,997

(22) Filed: Dec. 23, 2013

(65) Prior Publication Data

US 2014/0187344 A1 Jul. 3, 2014

Related U.S. Application Data

(60) Provisional application No. 61/746,815, filed on Dec. 28, 2012, provisional application No. 61/788,485, filed on Mar. 15, 2013.

(51) Int. Cl.
*A63B 53/02* (2015.01)
*A63B 53/00* (2015.01)

(52) U.S. Cl.
CPC ..... *A63B 53/007* (2013.01); *A63B 2053/023* (2013.01); *Y10T 29/49826* (2015.01)

(58) Field of Classification Search
CPC ..... A63B 53/02; A63B 53/065; A63B 53/007; A63B 2053/023
See application file for complete search history.

(56) References Cited

U.S. PATENT DOCUMENTS

| | | | | |
|---|---|---|---|---|
| 2,155,830 | A | 4/1939 | Howard | |
| 2,217,338 | A | 10/1940 | Fuller | |
| 3,430,957 | A | 3/1969 | Andis | |
| 4,073,492 | A | 2/1978 | Taylor | |
| 4,736,951 | A | 4/1988 | Grant | |
| 5,390,918 | A | 2/1995 | Meyers et al. | |
| 6,213,889 | B1 | 4/2001 | Hamburger | |
| 7,241,229 | B2 | 7/2007 | Poynor | |
| 7,530,900 | B2 | 5/2009 | Holt et al. | |
| 8,088,019 | B1 | 1/2012 | Long et al. | |
| 8,182,358 | B2 | 5/2012 | Sander et al. | |
| 8,216,084 | B2 | 7/2012 | Bennett et al. | |
| 8,801,537 | B1 * | 8/2014 | Seluga et al. | 473/307 |
| 9,050,508 | B2 * | 6/2015 | Kitagawa | |
| 2011/0009207 | A1 | 1/2011 | Jansson | |
| 2011/0111881 | A1 * | 5/2011 | Sander et al. | 473/307 |
| 2011/0118045 | A1 * | 5/2011 | Sato et al. | 473/307 |
| 2011/0275449 | A1 * | 11/2011 | Hocknell et al. | 473/288 |
| 2012/0231896 | A1 * | 9/2012 | Seluga et al. | 473/314 |

(Continued)

OTHER PUBLICATIONS

International Search Report from corresponding PCT Application No. PCT/US2013/077796, dated Apr. 25, 2014.

(Continued)

*Primary Examiner* — Stephen Blau

(57) ABSTRACT

Embodiments of golf clubs with adjustable lie and loft and methods of manufacturing golf clubs with adjustable lie and loft are generally described herein. Other embodiments may be described and claimed.

8 Claims, 12 Drawing Sheets

(56) References Cited

U.S. PATENT DOCUMENTS

| | | | | |
|---|---|---|---|---|
| 2012/0258818 | A1 | 10/2012 | Beach et al. | |
| 2013/0288816 | A1* | 10/2013 | Nakamura | 473/309 |
| 2013/0324286 | A1 | 12/2013 | Sander et al. | |
| 2014/0080617 | A1* | 3/2014 | Llewellyn et al. | 473/246 |
| 2014/0349778 | A1* | 11/2014 | Knutson et al. | 473/307 |

OTHER PUBLICATIONS

Written Opinion of the International Searching Authority from corresponding PCT Application No. PCT/US2013/077796, dated Apr. 25, 2014.

* cited by examiner

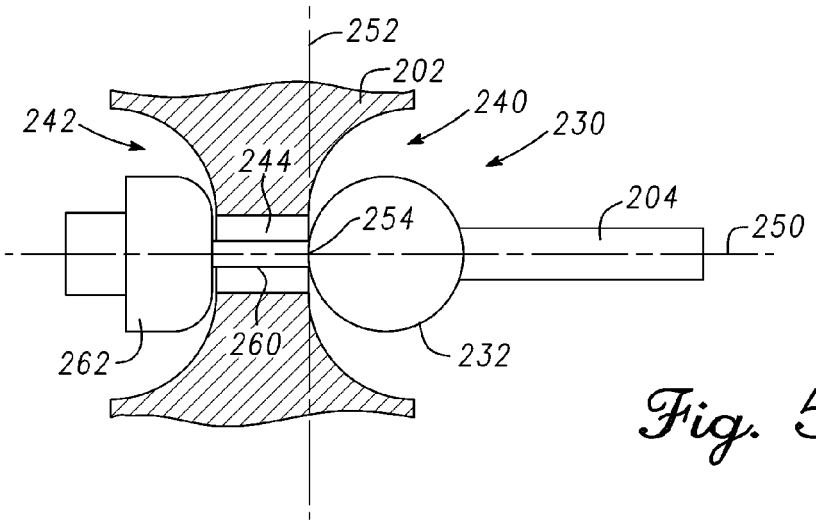
Fig. 5
Fig. 6
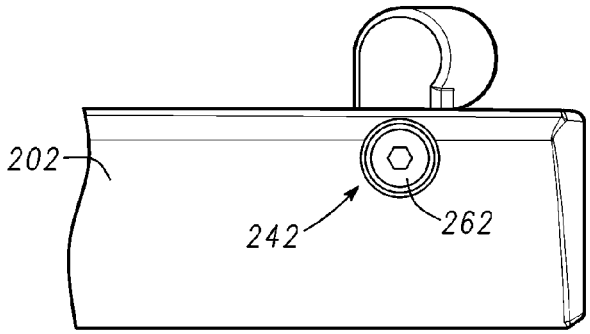
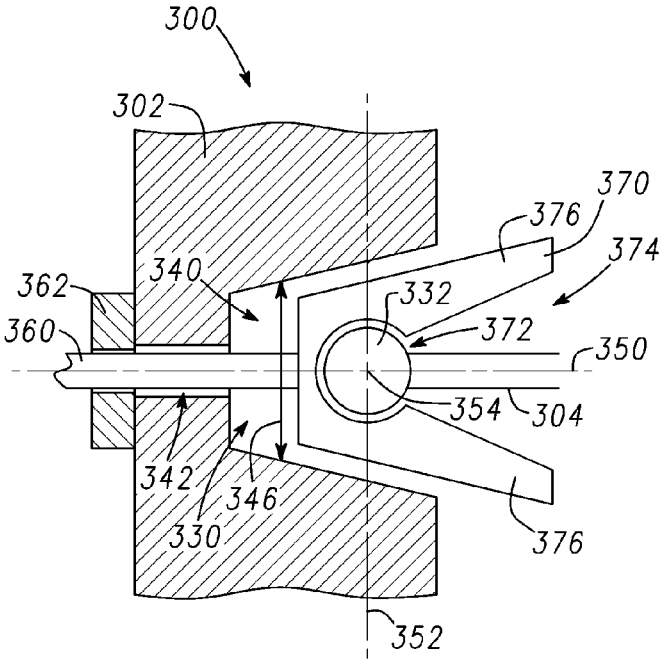
Fig. 7

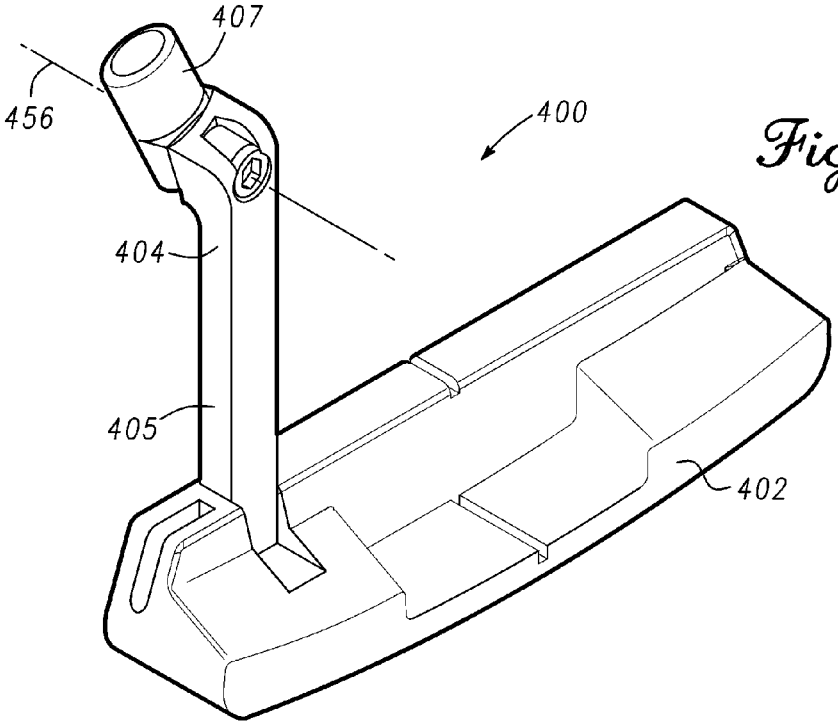
Fig. 8
Fig. 9
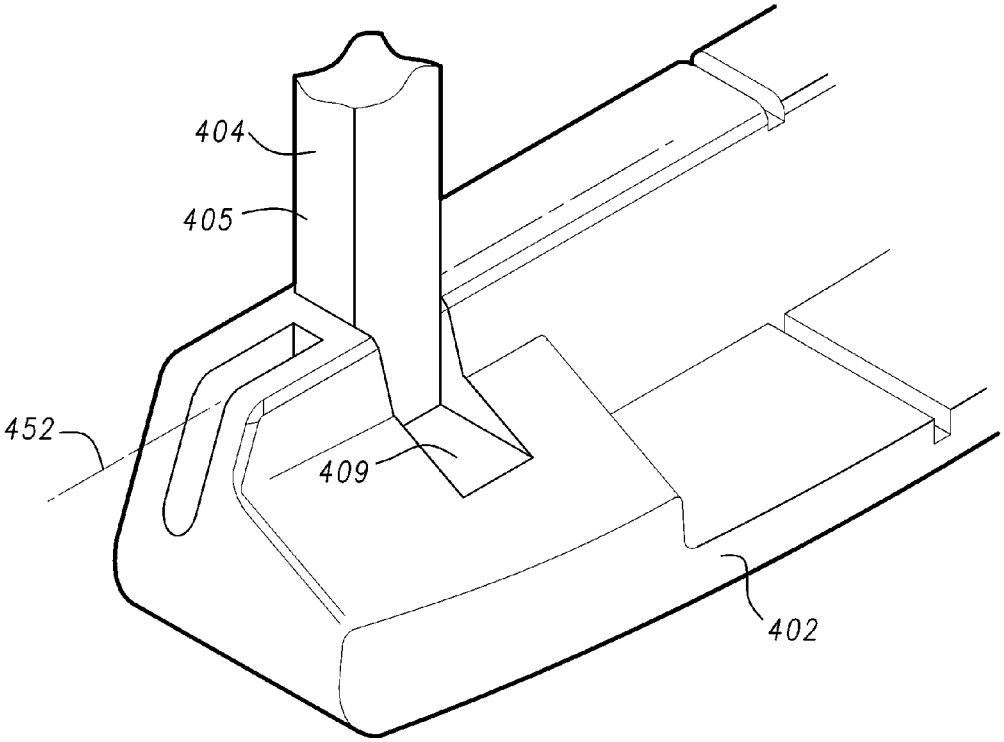

GOLF CLUBS WITH ADJUSTABLE LIE AND LOFT AND METHODS OF MANUFACTURING GOLF CLUBS WITH ADJUSTABLE LIE AND LOFT

RELATED APPLICATIONS

The present application claims priority from U.S. Provisional Application Ser. No. 61/746,815, filed Dec. 28, 2012; and U.S. Provisional Application Ser. No. 61/788,485, filed Mar. 15, 2013. The above listed applications are incorporated by reference.

FIELD

The present application generally relates to golf clubs, and more particularly, to golf clubs with adjustable lie and loft and methods of manufacturing golf clubs with adjustable lie and loft.

BACKGROUND

Golf clubs may be fitted to an individual based on the type of golf club, the individual's physical characteristics and/or the individual's play style. Depending on the individual's physical characteristics and play style, a golf club having a certain lie angle and loft angle may be selected to provide optimum performance for the individual. Accordingly, each individual may require a golf club having a certain lie and loft to fit the physical characteristics and the play style of the individual.

BRIEF DESCRIPTION OF THE DRAWINGS

FIG. 5 shows a cross-sectional diagram of the loft angle and the lie angle adjustment mechanism of the golf club of FIG. 4.

FIG. 6 shows a sole portion of the golf club head of the golf club of FIG. 4.

FIG. 7 shows a cross-sectional diagram of a loft angle and a lie angle adjustment mechanism for a golf club according to one embodiment.

FIG. 8 shows a golf club having a loft angle and a lie angle adjustment mechanism according to one embodiment.

FIG. 9 shows the loft angle adjustment mechanism of the golf club of FIG. 8.

DESCRIPTION

Figure 1:
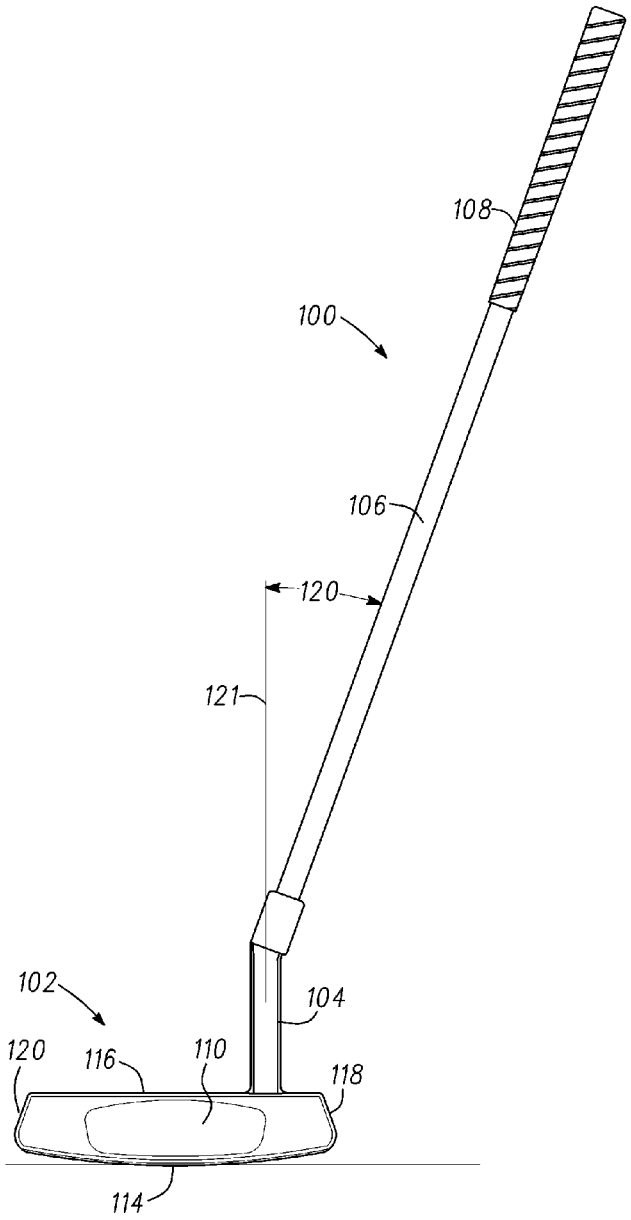
FIG. 1 shows an exemplary golf club.
Figure 2:
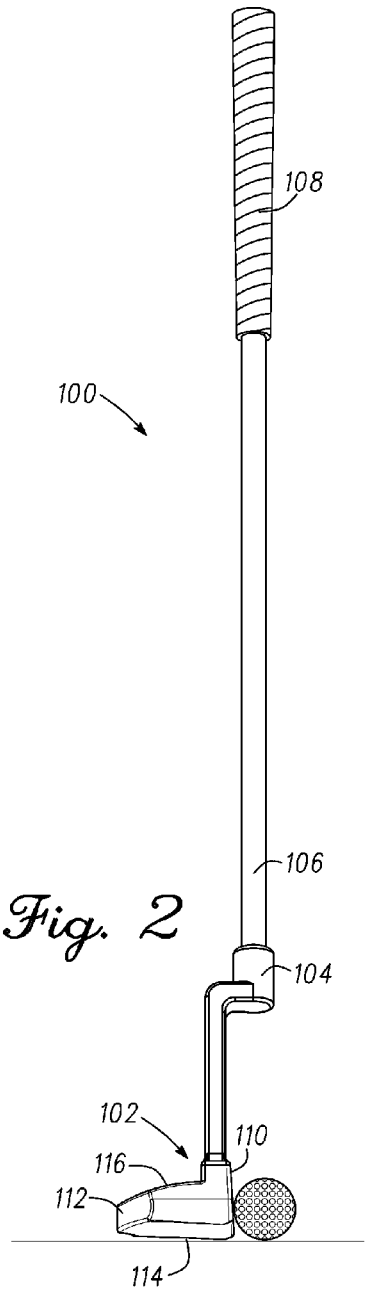
FIG. 2 shows an exemplary golf club.
Figure 3:
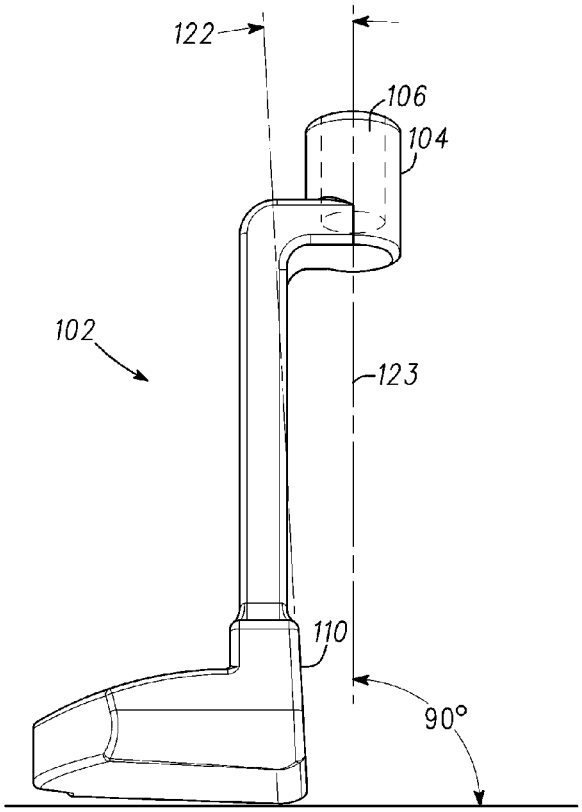
FIG. 3 shows an exemplary golf club.

Referring to FIGS. 1-3, a golf club 100 according to one example is shown. The golf club 100 includes a club head 102 that is coupled to a shaft 106. The head 102 may be connected directly to the shaft 106. In the examples of FIGS. 1-3, the club head is connected to the shaft 106 with a hosel 104 that may be a one-piece part with the club head 102 or a separate part that is connected to the club head 102. The shaft 106 is connected to the hosel 104. The shaft 106 may include a grip 108 by which an individual can hold and use the golf club 100 to strike a golf ball with a face portion 110 of the head 102. The golf club head 100 may be a wood-type golf club, such as a driver-type golf club head, a fairway wood-type golf club head (e.g., 2-wood golf club, 3-wood golf club, 4-wood golf club, 5-wood golf club, 6-wood golf club, 7-wood golf club, 8-wood golf club, or 9-wood golf club), a hybrid-type golf club head or any other suitable type of golf club head with a hollow body or a body with one or more cavities, apertures, recesses or channels. Although the disclosure may refer to a certain type of club, the apparatus, articles of manufacture, and methods described herein may be applicable to other suitable types of golf club heads.

The face portion 110 may be formed adjacent the hosel 104 and provides a surface for striking a golf ball (not shown). The golf club head 100 further includes a back portion 112 formed opposite to the face portion 110 with a sole portion 114 being defined between the back portion 112 and the face portion 110. A top rail portion 116 may be formed opposite to the sole portion 114 whereas the face portion 110 is defined by a heel portion 118 formed adjacent the hosel 104 and a toe portion 120 defined at the far end of the face portion 110 and opposite to the heel portion 118. Although the golf club head 100 may conform to rules and/or standards of golf defined by various golf standard organizations, governing bodies, and/or rule establishing entities, the apparatus, articles of manufacture, and methods described herein are not limited in this regard.

Referring to FIG. 1, a shaft lie angle 120 of the golf club 100 may be defined by the angle between the shaft 106 and the vertical, which is represented in FIG. 1 with the vertical line 121, when the club head 102 is generally horizontally oriented. Referring to FIG. 3, a shaft loft angle 122 may be defined as the angle between the face portion 110 of the club head 102 and the club shaft 106 when the center line 123 of the club shaft 106 is generally vertical, i.e., forms a generally 90° angle with the ground.

Figure 4:
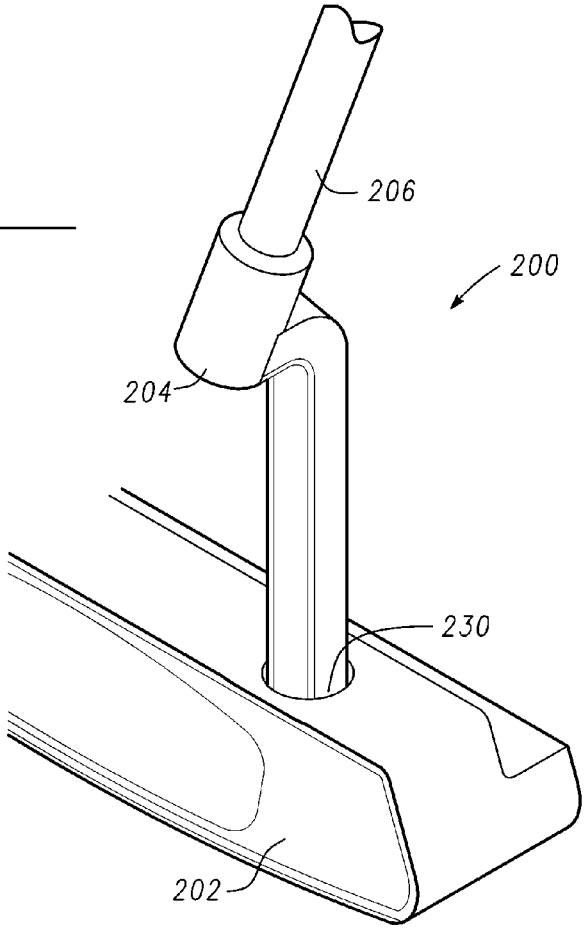
FIG. 4 shows a portion of a golf club having a loft angle and a lie angle adjustment mechanism according to one embodiment.

Referring to FIG. 4, a golf club 200 having an adjustable shaft lie angle and loft angle mechanism according to one example is shown. The golf club 200 includes a head 202, a hosel 204 and a shaft 206. The golf club 200 may be similar in many respects to the golf club 100. Accordingly, same parts may be referred to with the same reference numbers and the detailed description of the golf club 200 is not provided for brevity. The head 202 includes a bore 230 that is sized to movably receive a portion of the hosel 204. According to one example, the inner diameter of at least a portion of the bore 230 may be sufficiently greater than the outer diameter of the portion of the hosel 204 that is located inside the bore 230 to allow the hosel 204 to rotate relative to the bore 230.

Referring to FIG. 5, a schematic cross-sectional diagram of the head 202 with the hosel 204 attached thereto is shown. The end of the hosel 204 that is located inside the bore 230 may be any shape such as curved, semi spherical, or spherical. In the example of FIG. 5, the hosel 204 is shown to have a spherical end 232. The bore 230 may include a first bore portion 240, a second bore portion 242, and a connecting bore portion 244 by which the first bore portion 240 and the second bore portion 242 are connected. The first bore portion 240 may be in any shape such as a curved shape, a bowl shape, or a semi spherical shape. In the example of FIG. 5, the first bore portion 240 is bowl shaped and has a generally larger inner diameter than the diameter of the spherical end 232. Accordingly, the spherical end 232 is rotatable inside the first bore portion 240 about axes 250, 252, and 254.

A bolt 260 extends from the spherical end 232 through the connecting bore portion 244 and at least partly through the second bore portion 242. A nut 262, which is sized to be inserted into the second bore portion 242, may engage with the bolt 260. The nut 262 may be in any shape such as a curved shape, a semi spherical shape, or a shape that generally matches the contour of the interior of the second bore portion 242. When the nut 262 is tightened over the bolt 260, the distance between the spherical end 232 and the nut 262 is reduced. Accordingly the spherical end 232 is pressed against the bottom of the first bore portion 240 and the nut 262 is pressed against the bottom of the second bore portion 242. The frictional engagement between the spherical end 232 and the bottom of the first bore portion 240, and the frictional engagement between the nut 262 and the bottom of the second bore portion 242 can prevent the hosel 204 from rotating relative to the head 202. When the nut 262 is sufficiently loosened, the hosel 204 may be rotated about the axes 250, 252 and 254 (perpendicular to the page in FIG. 5) to position the hosel 204 relative to the head 202 at a certain lie angle and/or loft angle. Once a certain lie angle and/or loft angle is reached, the nut 262 may be tightened to fix the position of the hosel 204 relative to the head 202 at the certain lie angle and loft angle.

Referring to FIG. 7, a portion of a golf club 300 having an adjustable shaft lie angle and loft angle mechanism according to another example is shown. The golf club 300 includes a head 302, a hosel 304 and a shaft (not shown). The golf club 300 may be similar in many respects to the golf club 100. Accordingly, same parts may be referred to with the same reference numbers and the detailed description of the golf club 300 is not provided for brevity. The head 302 includes a bore 330 that is sized to movably receive the hosel 304. The end of the hosel 304 that is located inside the bore 330 may be any shape such as curved, semi spherical, or spherical. In the example of FIG. 7, the hosel 304 is shown to have a spherical end 332. The bore 330 may include a first bore portion 340 and a second bore portion 342. The first bore portion 340 may have a wedge or conical shape such that the inner diameter 346 of the first bore portion 340 is gradually reduced with increasing depth. The golf club 300 also includes a clamp or sleeve, which may be referred to herein as the sleeve 370. The sleeve may generally have a shape corresponding to the shape of the first bore portion 340. The sleeve 370 includes a generally curved or spherical cavity 372 and an opening 374 defined by two arms 376. The sleeve 370 may have a generally larger outer diameter as defined by the arms 376 than the inner diameter 346 of the first bore portion 340. Accordingly, when the sleeve 370 is inserted deeper into the first bore portion 340, the arms 376 move toward each other to reduce the size of the spherical cavity 372 and the opening 374. The spherical end 332 may be sized for insertion into the spherical cavity 372 and to be freely rotatable inside the spherical cavity 372. As the sleeve 370 is inserted deeper into the first bore portion 340, the size of the spherical cavity 372 is reduced. Accordingly, the walls of the spherical cavity 372 frictionally engage the spherical end 332 to prevent rotation of the spherical end 332 inside the spherical cavity 372.

A bolt 360 extends from the spherical end 332 or the sleeve 370 through the second bore portion 246. A nut 362 may be engaged with the bolt 360. When the nut 362 is tightened over the bolt 360, the sleeve 370 is drawn deeper into the first bore portion 342 from the sole portion. Accordingly, the spherical cavity 372 frictionally engages the spherical end 332 to prevent rotation of the spherical end 332 inside the spherical cavity 372. When the nut 362 is sufficiently loosened, the hosel 304 may be rotated about axes 350, 352 and 354 (perpendicular to the page in FIG. 7) to position the hosel 304 relative to the head 302 at a certain lie angle and loft angle. Once a certain lie angle and loft angle is reached, the nut 362 may be tightened to fix the position of the hosel 304 relative to the head 302 at the certain lie angle and loft angle.

Referring to FIG. 8, a golf club 400 having an adjustable shaft lie angle and loft angle mechanism according to another example is shown. The golf club 400 includes a head 402, a hosel 404 and a shaft (not shown). The golf club 300 may be similar in many respects to the golf club 100. Accordingly, same parts may be referred to with the same reference numbers and the detailed description of the golf club 400 is not provided for brevity. The hosel 404 may include two sections, which are a first hosel section 405 that connects with the head 402 and a second hosel section 407 that connects with the shaft. The angle between the first hosel section 405 and the second hosel section 407 may be adjusted by rotating the second hosel section 407 relative to the first hosel section 405 about an axis 456 to adjust the lie angle of the golf club 400. Referring to FIG. 9, the first hosel section 405 may be rotatably mounted in a slot 409 of the head with a pin 457 engaging a bore 459 in the head 402 and a bore 461 in the first hosel section 405. The first hosel section 405 may be rotatable about an axis 452, which his defined by the pin 457 and the bores 459 and 461, to adjust the loft angle of the head 402 as described in detail below.

Figure 10:
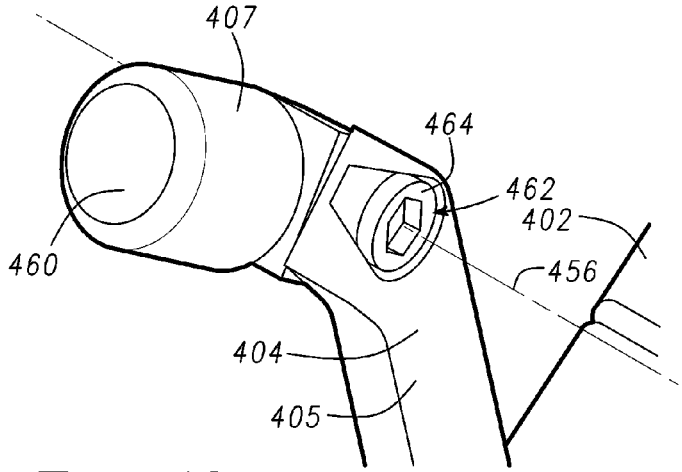
FIG. 10 shows the lie angle adjustment mechanism of the golf club of FIG. 8.
Figure 11:
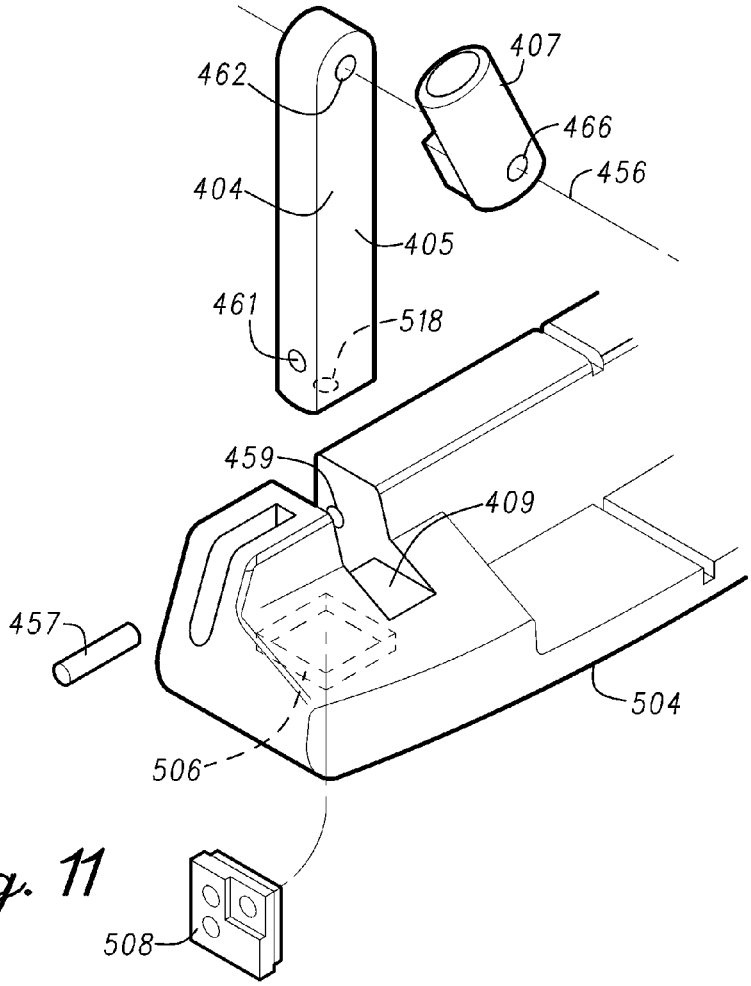
FIG. 11 shows an exploded view of the loft angle and lie angle adjustment mechanism of the golf club of FIG. 8.

Referring to FIG. 10, the mechanism for changing the lie angle operates by allowing the second hosel section 407 to rotate relative to the first hosel section 405 about the axis 456. The second hosel section 407 includes a generally cylindrical cavity 460 for receiving the shaft (not shown) of the golf club 400. In the example of FIG. 10, the first hosel section 405 includes a bore 462 for receiving a head of a bolt 464 and the second hosel section 407 may include a bore (not shown) for receiving a threaded section (not shown) of the bolt 464. In the example of FIG. 11, the first hosel section 405 includes a threaded bore 462 for receiving the threaded section of the bolt 464. The second hosel section 407 includes a bore 466 for receiving the head of the bolt 464. When the bolt 464 is tightened, the first hosel section 405 and the second hosel section 407 are pressed against each other and frictionally prevented from rotating relative to each other about the axis 456. Thus, loosening the bolt 464 allows an individual to adjust the lie angle of the golf club 400 to a certain lie angle by rotating the second hosel section 407 relative to this first hosel section 405. The individual can then tighten the bolt 464 to fix the second hosel section 407 to the first hosel section 405 to maintain the lie angle.

Figure 12:
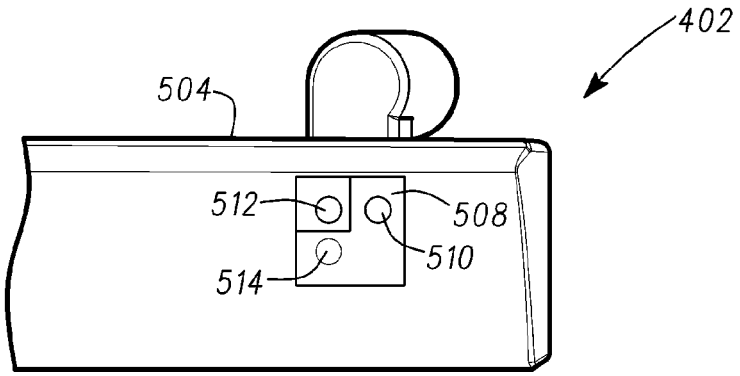
FIG. 12 shows the sole portion of the golf club head of the golf club of FIG. 8.
Figure 13:
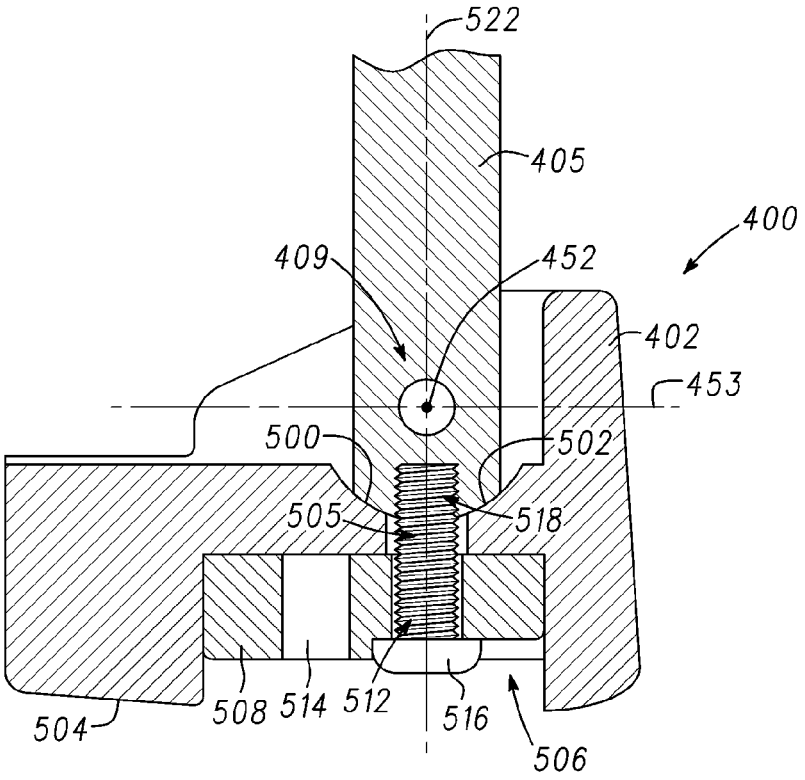
FIGS. 13-15 are cross-sectional views of the golf club head of FIG. 8 showing three different loft angle settings, respectively, of the loft adjustment mechanism.
Figure 14:
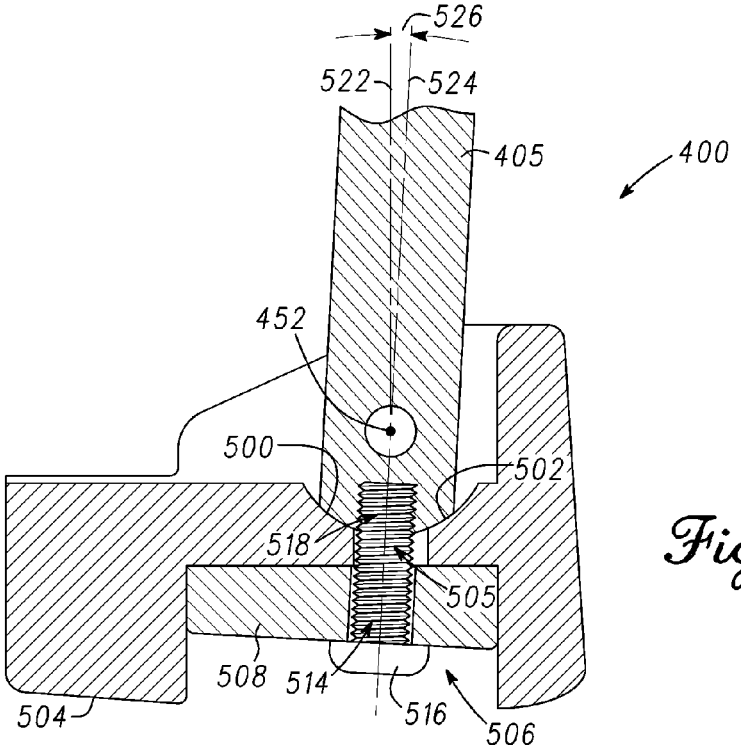
Figure 15:
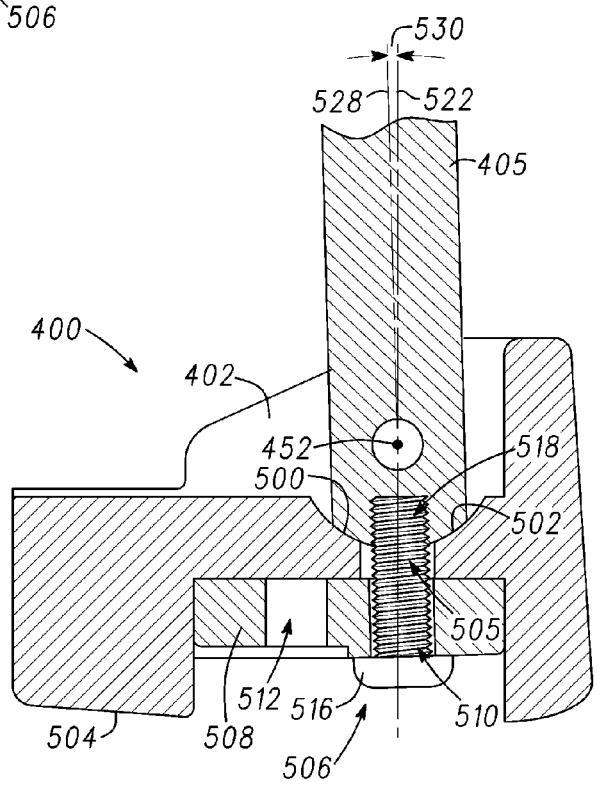
Figure 16:
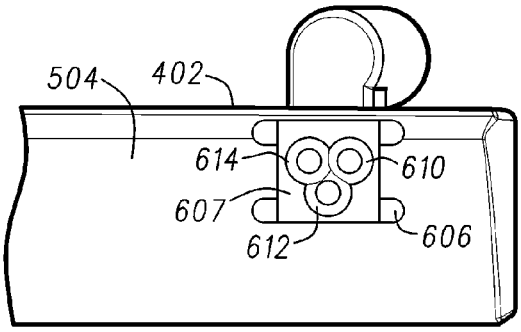
FIG. 16 shows the sole portion of a golf club having a loft angle adjustment mechanism according to one embodiment.
Figure 17:
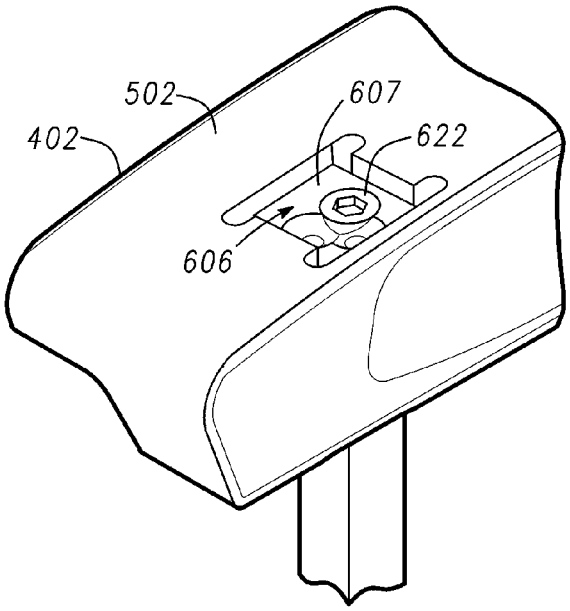
FIG. 17 shows a perspective view of a sole portion of the golf club of FIG. 16.
Figure 18:
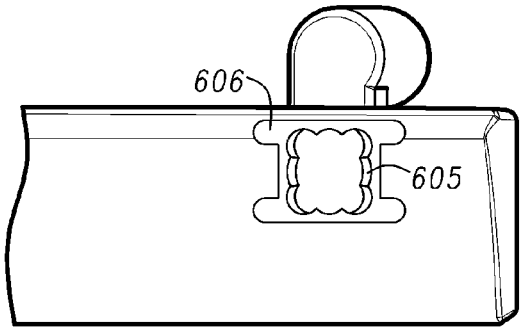
FIG. 18 shows a recess in the sole portion of the golf club of FIG. 16.

Referring to FIGS. 11-15, the loft angle adjustment mechanism of the golf club 400 is shown in more detail. The first hosel section 405 may have a generally curved first end 500 (shown in FIG. 13), which may contact a correspondingly curved bottom section 502 of the slot 409 for rotation of the first hosel section 405 about the axis 452. The head 402 includes a passage 505 that connects the slot 409 to a recess 506 on the sole portion 504 of the head 402. The recess 506 is configured to receive a correspondingly shaped insert 508. In the examples of FIGS. 11-15, the recess 506 is generally rectangular. Accordingly, the insert 508 may also be generally rectangular. However, the recess 506 and/or the insert 508 may have any configuration. Furthermore, as shown in FIGS. 13-15, the insert 508 may be a plate with a thickness that is less than the depth of the recess 506. Therefore, the insert 508 may be completely inserted into the recess 506 such that no part of the insert 508 protrudes from the recess 506. As shown in FIGS. 11 and 12, the insert 508 includes three holes 510, 512 and 514 for receiving a bolt 516. As described in detail below, the holes 510, 512 and 514 correspond to three different loft angle settings. Referring to FIGS. 11 and 13-15, the second hosel section 405 includes a bore 518 at the first end 500. The bore 518 may be threaded to receive a correspondingly threaded portion of the bolt 516.

The holes 510, 512 and 514 may correspond to three different loft angle settings. For example, the hole 512 may correspond to a certain loft angle setting while the holes 510 and 514, which are located on each side of the hole 512, may correspond to a higher loft angle setting and a lower loft setting relative to the hole 512, respectively. For example, the hole 512 may correspond to a neutral loft angle setting, the hole 510 may correspond to a positive 2° loft angle setting relative to the neutral loft angle setting, and the hole 514 may correspond to a −2° loft angle setting relative to the neutral loft angle setting. To provide the noted loft angle settings, each hole 510, 512 or 514 may be oriented relative to a plane defining the insert 508 at a certain angle that corresponds to the hole's loft angle setting. For example, the hole 512 may correspond to a neutral loft angle setting. Accordingly, the hole 512 may be oriented generally perpendicular to the plane defining the insert 508. In other words, the axis of the hole 512 may be generally perpendicular to the plane defining the insert 508. The hole 510 may be oriented at a positive 2° relative to the plane defining the insert 508, and the hole 514 may be oriented at a −2° angle relative to the plane defining the insert 508. Thus, when the bolt 516 is inserted in each hole 510, 512 or 514, the bolt 516 is also oriented along the same angle as the hole 510, 512 or 514, respectively. The insert 508 may include any number of holes, where each hole may correspond to a certain loft angle of the head. For example, the insert 508 may include five holes corresponding to loft angles of −2°, −1°, 0, 1°, 2°, respectively.

Referring to FIG. 13, a neutral loft angle setting of the golf club 400 is shown. To place the head 402 in the neutral loft angle setting, the insert 508 may be removed from the recess 506, rotated so that the hole 512, which may correspond to the neutral loft angle setting, is aligned with the passage 505, and re-inserted into the recess 506. The second hosel section 405 is also rotated about the axis 452 (the axis 452 may also represent a center of the curvature of the curved first end 500) such that the bore 518 of the passage 505 and the hole 512 are generally coaxial and share a common axis 522. Accordingly, the loft angle of the head 402 may be generally positioned at the neutral loft angle as defined by the angle of the axis of the hole 512 relative to the plane defining the insert 508. To fix the head 402 at the neutral loft angle, the bolt 516 may be inserted in the hole 512, extended through the passage 505, and screwed into the bore 518. Therefore, tightening the bolt 516 can fix the position of the second hosel section 405 relative to the head 402 at the neutral loft angle.

Referring to FIG. 14, a positive loft angle setting of the golf club 400 is shown. For example the positive loft angle may be 2°. To place the head 402 in the positive loft angle setting, the insert 508 may be removed from the recess 506, rotated so that the hole 514, which may corresponds to the positive loft angle setting, is aligned with the passage 505, and re-inserted into the recess 506. The second hosel section 405 is also rotated about the axis 452 such that the bore 518, the passage 505 and the hole 514 are generally coaxial and share a common axis 524. As shown in FIG. 14, the common axis 524 forms a positive angle 526 with the common axis 522 of the neutral loft angle setting. Accordingly, the loft angle of the head 402 is generally positioned at the positive loft angle as defined by the angle of the hole 514 relative to the plane defining the insert 508. To fix the head 402 at the positive loft angle, the bolt 516 may be inserted in the hole 512, extended through the passage 505, and screwed into the bore 518. Therefore, tightening the bolt 516 can fix the position of the second hosel section 405 relative to the head 402 at the positive loft angle.

Referring to FIG. 15, a negative loft angle setting of the golf club 400 is shown. For example the negative loft angle may be −2°. To place the head 402 in the negative loft angle setting, the insert 508 may be removed from the recess 506, rotated so that the hole 510, which corresponds to the negative loft angle setting, is aligned with the passage 505, and re-inserted into the recess 506. The second hosel section 405 is also rotated about the axis 452 such that the bore 518, the passage 505 and the hole 510 are generally coaxial and share a common axis 528. As shown in FIG. 15, the common axis 528 forms a negative angle 530 with the common axis 522 of the neutral loft angle setting. Accordingly, the loft angle of the head 402 is generally positioned at the negative loft angle as defined by the angle of the hole 510 relative to the plane defining the insert 508. To fix the head 402 at the negative loft angle, the bolt 516 may be inserted in the hole 510, extended through the passage 505, and screwed into the bore 518. Therefore, tightening the bolt 516 can fix the position of the second hosel section 405 relative to the head 402 at the negative loft angle.

Figure 19:
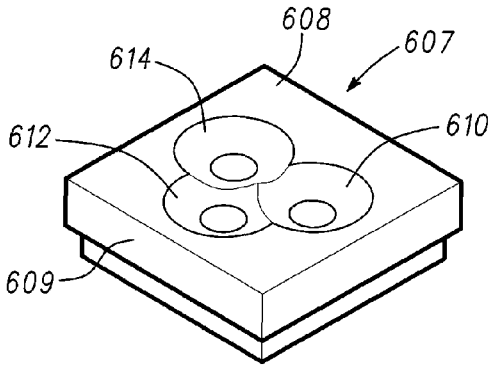
FIGS. 19 and 20 show an insert configured for insertion into the recess of FIG. 18.
Figure 20:
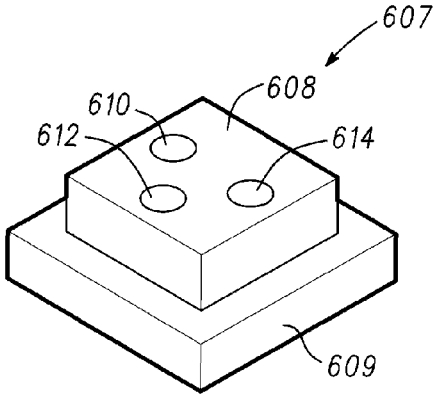
Figure 21:
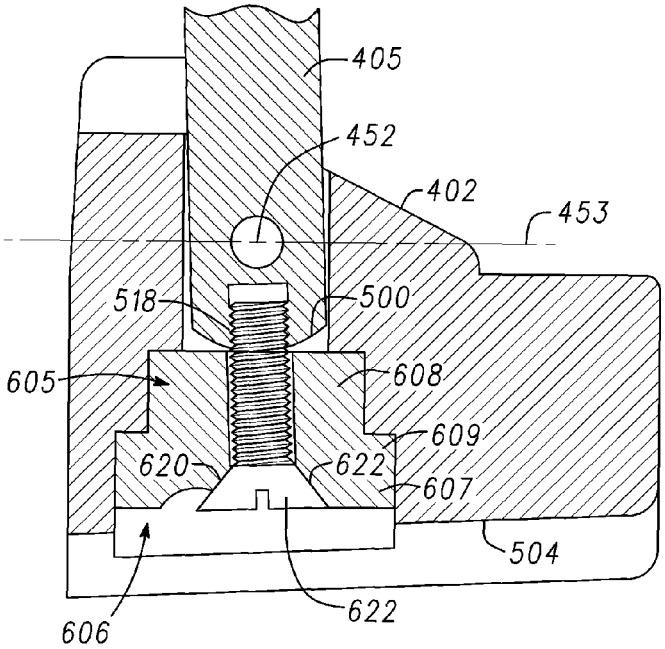
FIG. 21 is a cross-sectional view showing a loft angle setting of the loft angle and lie angle adjustment mechanism of the golf club of FIG. 16.

Referring to FIGS. 16-21, another exemplary loft angle adjustment mechanism for the golf club 400 is shown. As described above, the first hosel section 405 may have a generally curved first end 500. The head 402 includes a passage 605 (shown in FIGS. 18 and 21) that connects the slot 409 to a recess 606 on the sole portion 504 of the head 402. The recess 606 is configured to receive a correspondingly shaped insert 607. The recess 606 and the insert 607 may be in any shape. As shown in FIG. 21, the recess 606 may be generally larger than the passage 605. The insert 607 includes a first section 608 and a second section 609. The first section 608 is shaped and configured for insertion into the passage 605 with little or no play. For example, the dimensions of the first section 608 may be slightly smaller than the corresponding dimensions of the passage 605. Accordingly, the first section 608 may be slidably inserted into the passage 605. The second section 609 is shaped and configured for insertion into the recess 606 with little or no play. For example, the dimensions of the second section 609 may be slightly smaller than the corresponding dimensions of the recess 606. Accordingly, the second section 609 may be slidably inserted into the recess 606. Because the recess 606 is generally larger than the passage 605, further insertion of the first section 608 into the passage 605 is prevented by the section 609 beings stopped by a ledge 611 between the recess 606 and the passage 605. The thickness of the second section 609 is less than the depth of the recess 606. Therefore, no part of the second section 609 protrudes from the recess 606.

Referring to FIGS. 19 and 20, the insert 607 may include three holes 610, 612 and 614 for receiving a bolt 616. Referring to FIG. 21, the second hosel section 405 includes a bore 518 at the first end 500. The bore 518 may be threaded to receive a correspondingly threaded portion of the bolt 616. The holes 610, 612 and 614 may extend through the first section 608 and the second section 609 of the insert 607. The holes 610, 612 and 614 may correspond to three different loft angle settings. For example, the hole 612 may correspond to a certain loft setting while holes 610 and 614 which are located on opposite of the hole 612 may correspond to an increasing loft setting and a decreasing loft setting relative to the hole 612, respectively. For example, hole 612 may correspond to a neutral loft angle setting, hole 610 may correspond to a positive 2° loft angle setting relative to the mutual loft angle setting, and hole 614 may correspond to a −2° loft angle setting relative to the mutual loft angle setting. To provide the noted loft angle settings, each hole 610, 612 and 614 may be oriented relative to a plane defining the insert 607 at a certain angle that corresponds to the hole's loft angle setting. For example, because the hole 612 may correspond to a neutral loft angle setting, hole 612 may be oriented generally perpendicular to the plane defining the insert 607. In other words, the axis of the hole 612 may be generally perpendicular to the plane defining the insert 607. Similarly, hole 610 may be oriented at a positive 2° relative to the plane defining the insert 607, and the hole 614 may be oriented at a −2° angle relative to the plane defining the insert 607. Thus, when the bolt 616 is inserted in each hole 610, 612 or 614, the bolt 616 is also oriented along the same angle as the hole 610, 612 or 614, respectively. The insert 607 may include any number of holes, where each hole may correspond to a certain loft angle of the head. For example, an insert 607 may include five holes corresponding to loft angles of −2°, −1°, 0, 1°, 2°, respectively.

Adjusting the loft angle of the golf club with the insert 607 may be similar to adjustment of the loft angle with the insert 508. Therefore, operation of adjusting the loft angle with the insert 607 is not described in detail. Similar to the operation of the insert 508, the insert 607 may be removed from the recess 606 and rotated prior to being re-inserted into the passage 605 and the recess 606 so that one of the holes 610, 612 or 614 corresponding to a certain loft angle is alignable with the bore 518 of the hosel 405. The bolt 616 can then be inserted into the hole 610, 612 or 614 and engaged with the threads in the bore 518 of the hosel 405 after the hosel 405 is rotated about the axis 452 to a certain loft angle. Tightening the bolt 616 then fixes the loft angle of the head 402. Referring to FIG. 21, each hole 610, 612 and 614 may include a tapered opening 620 to receive the bolt 616, which may also have a countersink head 622. The tapered opening 620 may align the bolt 616 along the axis of the hole 610, 612 or 614. Furthermore, the tapered opening positions the head of the bolt 616 flush with the insert 607. However, the holes 610, 612 and 614 and the bolt 616 may be in any configuration. The apparatus, methods, and articles of manufacture described herein are not limited in this regard.

Referring to FIGS. 13 and 21, the hosel 405 may be rotatable about an axis 453 for adjusting a lie angle of the head 402 relative to the shaft. The head 402 may include a bore (not shown) at a front portion of the head 402 and/or a back portion of the head 402 for receiving a pin (not shown). The pin and the bore may define the axis 453. Adjusting the lie angle of the head 402 is similar to the loft angle adjustment described above. The inserts 508 or 607 may be removed from the recess 506 or 606 and rotated prior to being re-inserted in the recess 506 or 606, respectively, so that one of the holes of the insert corresponding to a certain lie angle is alignable with the bore 518 of the hosel 405. The bolt 516 or 616 can then be inserted into the selected hole. The hosel 405 is then rotated about the axis 453 to a certain lie angle and the bolt 516 or 616, respectively, is engaged with the threads in the bore 518 of the hosel 405. Tightening the bolt 516 or 616 then fixes the lie angle of the head 402. Thus, rotation of the hosel 405 about the axis 452 or the axis 453 in combination with operation of the insert 508 or 607 provides for adjustment of the loft angle or the lie angle, respectively.

A bolt according to the disclosure may be any type of threaded bolt that may be operated by commonly available tools. For example, the bolt may have a hex head so as to be operated by a hex wrench. Alternatively, the bolt may be a proprietary bolt having a head that may be operated by a proprietary tool. Accordingly, a tool may be provided with the golf club as a part of a kit so that an individual can operate the bolt. A tool and/or a bolt according to the disclosure may be constructed from any metal or metal alloys, plastic, composite materials, wood or a combination thereof.

In the examples described above, the bolt is inserted into a hole of the insert from the sole portion and engages with the threaded bore of the hosel. Alternatively, a bolt may be attached to the first end of the hosel such that when the hosel is connected to the head, the bolt extends through the passage and into the recess. Accordingly, a nut may be provided for engaging the bolt in the recess and over the insert to fasten the insert to the head.

According to the disclosure, a golf club may include a hosel and a shaft, where the hosel connects the shaft to the golf club head. However, a golf club may include a shaft that is directly attached to the golf club head and provides any of the disclosed mechanisms for adjusting the loft angle of the head. Accordingly, a hosel may refer to a certain portion of a shaft that is attached to the golf club head. Alternatively, a golf club may include a hosel that is a continuous one-piece part with the golf club head. Accordingly, the hosel may be a part of the head and be directly attached to the shaft. Thus, any of the hosel and the shaft, or the hosel and the head may represent a one-piece continuous part or two independent parts as disclosed.

Figure 22:
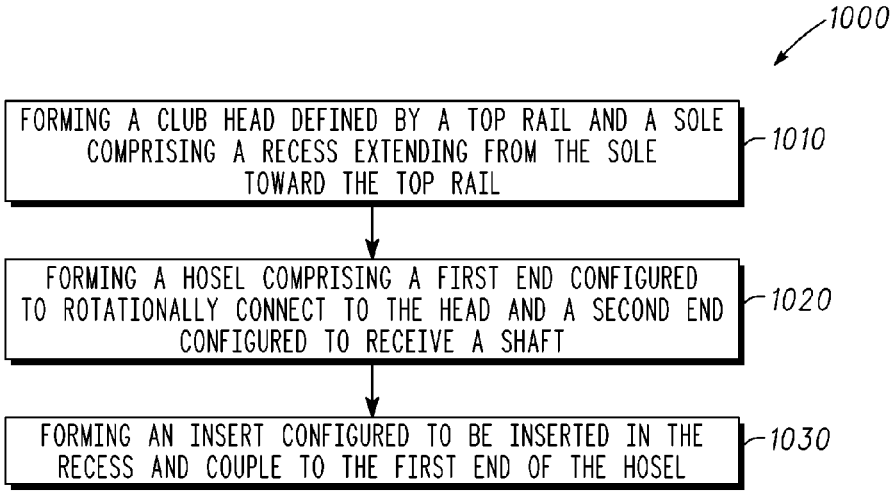
FIG. 22 shows a method of manufacturing a golf club according to one embodiment.

Referring to FIG. 22, a method 1000 of manufacturing a golf club according to the disclosure is shown. The method 1000 may include forming a club head defined by a top rail portion and a sole portion comprising a recess extending from the sole portion toward the top rail portion (block 1010), forming a hosel including a first end configured to rotationally connect to the head and a second end configured to receive a shaft (block 1020), and forming an insert configured to be inserted in the recess and couple to the first end of the hosel (block 1030). The insert may be configured to be positioned in the recess at a plurality of different rotational positions corresponding to a plurality of different angles between the head and the shaft. The method 1000 may include forming a threaded bore in the first end of the hosel for receiving a bolt, and forming a plurality of holes in the insert such that each hole corresponds to a different angle between the head and the shaft of the golf club. As disclosed, a bolt may be inserted in the insert from the sole portion to engage the threaded bore to fix the loft and/or lie angle of the shaft relative to the head. Alternatively, the method 1000 may include forming a bolt at the first end of the hosel, and forming a plurality of holes in the insert such that each hole corresponds to a different angle between the head and the shaft of the golf club. As disclosed, the bolt may be inserted through one of the holes of the insert and engaged with a fastener on the sole portion to fix the loft and/or lie angle of the shaft relative to the head. Accordingly, at each of the plurality of rotational positions of the insert, the hole corresponding to the rotational position is alignable with the threaded bore of the hosel or the bolt at the first end of the hosel to provide engagement of the bolt through the hole and with the threaded bore or with fastener on the sole portion.

Any golf club head according to the disclosure may be constructed from any type of material, such as stainless steel, aluminum, titanium, various other metals or metal alloys, composite materials, natural materials such as wood or stone or artificial materials such as plastic. Any golf club head according to the disclosure may be constructed by stamping (i.e., punching using a machine press or a stamping press, blanking, embossing, bending, flanging, or coining, casting), injection molding, forging, machining or a combination thereof, or other processes used for manufacturing metal, composite, plastic or wood parts. A golf club head may be manufactured to include a recess, a passage and/or any of the disclosed internal structures. For example, a golf club head may be machined from aluminum such that the golf club head includes a recess, a passage and/or any of the disclosed internal structures. Alternatively, any recess and/or passages inside the golf club head according to the disclosure may be cut into the golf club head after manufacturing the golf club head.

The hosel and/or golf club shaft according to the disclosure may be constructed from any type of material, such as stainless steel, aluminum, titanium, various other metals or metal alloys, composite materials, natural materials such as wood or stone or artificial materials such as plastic. A hosel and/or golf club shaft according to the disclosure may be constructed by stamping (i.e., punching using a machine press or a stamping press, blanking, embossing, bending, flanging, or coining, casting), injection molding, forging, machining or a combination thereof, or other processes used for manufacturing metal, composite, plastic or wood parts. For example, a shaft constructed from graphite may be formed by a sheet lamination process, filament winding process or resin transfer molding process. A bore may be machined in the hosel and threaded for receiving a bolt as disclosed. The bolt may be a bolt having a configuration for engaging the threads in the bore. An insert according to the disclosure may be constructed from any material such as plastics, metals, composite materials, wood and/or any artificial or natural materials. According to one example, an inserts may be machined from aluminum to include any holes for receiving a bolt.

Referring to FIGS. 23-29, another exemplary loft angle and lie angle adjustment mechanism for the golf club 400 is shown. The loft angle and lie angle adjustment mechanism of FIGS. 23-29 may be manufactured and/or assembled by any one or a combination of disclosed methods for manufacturing a golf club or any of the disclosed loft angle and lie angle adjustment mechanisms. Certain components and/or parts of the loft and lie angle adjustment mechanism of FIGS. 23-29 may be similar in many respects to the same or similar parts as the disclosed loft and lie angle adjustment mechanisms. Accordingly, same parts may be referred to with the same reference numbers and details of such parts and/or components for the examples of FIGS. 23-29 may not be described in detail herein for brevity.

As described above, the first hosel section 405 may have a generally curved first end 500. The head 402 includes a passage 705 (shown in FIG. 26) that connects the slot 409 to a recess 706 on the sole portion 504 of the head 402. The recess 706 is configured to receive a correspondingly shaped insert 707 as described in detail below. The recess 706 may be in any shape. In the examples of FIGS. 23-29, the recess is circular. The bottom surface 710 of the recess 706 includes a plurality of adjustment recesses. In the example of FIGS. 23-29, the bottom surface 710 includes four adjustment recesses 712, 714, 716 and 718. Each adjustment recess may be radially positioned around the passage 706 relative to an adjacent adjustment recess. In the examples of FIGS. 23-29, each adjustment recess is radially spaced from an adjacent adjustment recess by around 90°. Accordingly, the adjustment recess 712 may be located at a reference position of 0°, the adjustment recess 714 may be located at 90°, the adjustment recess 716 may be located at 180°, and the adjustment recess 718 may be located at 270°. Thus, the adjustment recesses 712 and 716 may be generally linearly aligned and positioned opposite to each other and the adjustment recesses 714 and 718 may be generally linearly aligned and positioned opposite to each other. Any of the adjustment recesses may serve as a reference or 0° position. The adjustment recesses may have any shape. In the examples of FIGS. 23-29, the adjustment recesses are generally rectangular having an end that is open to the passage 705 and an opposite end that may be generally rounded. Each of the adjustment recesses 712, 714, 716 and 718 includes a bottom surface 713, 715, 717, and 719, respectively, which defines the depth of the corresponding adjustment recess. The adjustment recesses may have different depths and/or depth profiles. Each of the bottom surfaces 713, 715, 717, and 719 may be flat or have a certain angle relative to the bottom surface 710 of the recess 706.

Figure 23:
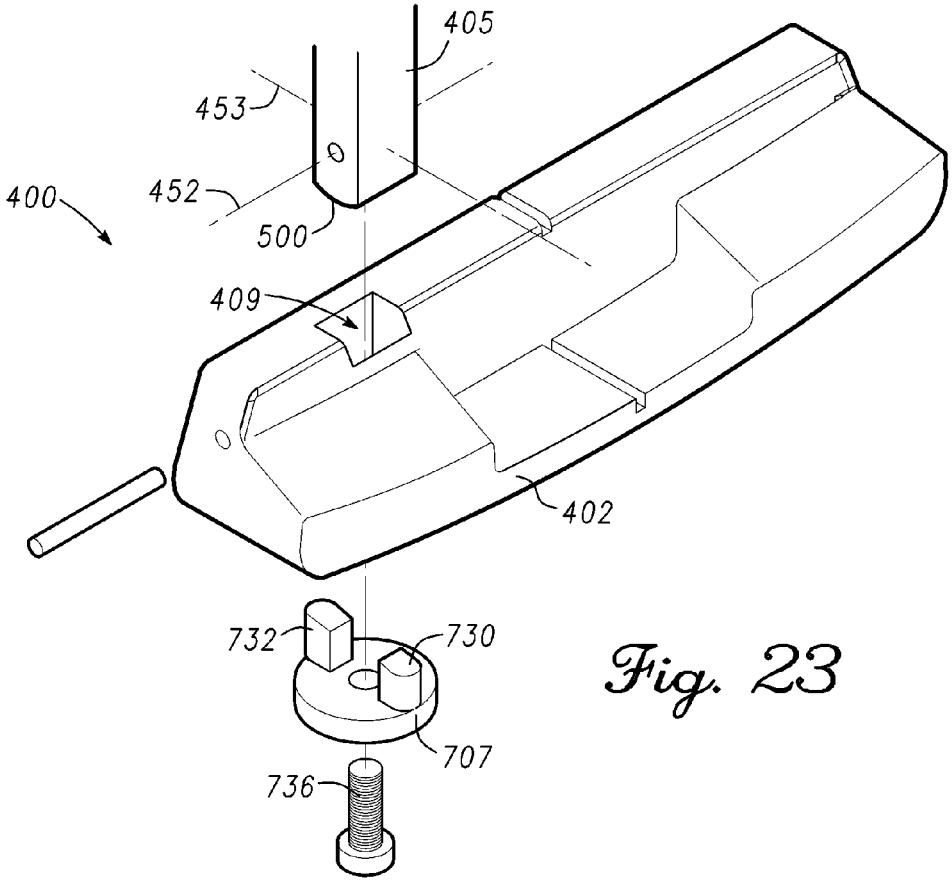
FIG. 23 shows an exploded view of the loft angle and lie angle adjustment mechanism for a golf club according to one embodiment.
Figure 24:
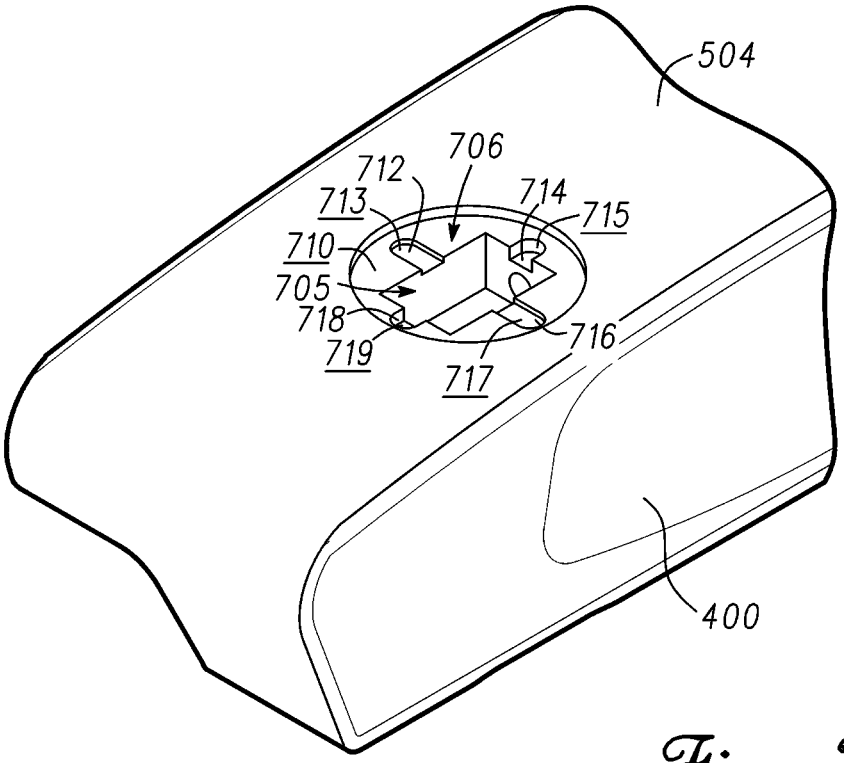
FIG. 24 shows a perspective view of a portion of the golf club of FIG. 23.
Figure 25:
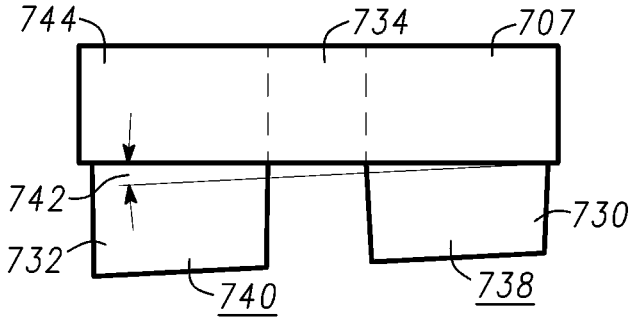
FIG. 25 shows a side view of a portion of the loft angle and lie angle adjustment mechanism for a golf club according to one embodiment.
Figure 26:
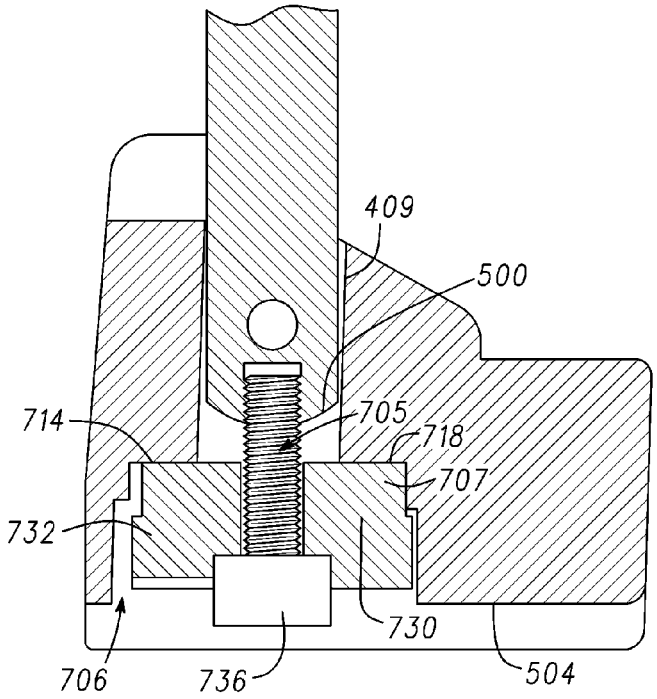
FIG. 26 is a cross-sectional view of the golf club head of FIG. 23 showing a loft angle setting of the loft angle and lie angle adjustment mechanism.

Referring to FIGS. 23 and 25, the insert 707 may include two projections 730 and 732 that are configured to at least partially fit inside the adjustment recesses 712, 714, 716 and 718. The insert 707 includes a bore 734 between the projections 730 and 732 for receiving a bolt 736, which is similar in many respects to the disclosed bolt 516 or 616. The top surfaces 738 and 740 of the projections 730 and 732, respectively, may be linearly aligned to define a plane oriented at an angle 742 relative to the main body 744 of the insert 707. The bore 734 may be generally perpendicular to the main body 744 of the insert 707. Accordingly, when the projections 730 and 732 are placed on a generally horizontal surface such that the plane defining the surfaces 738 and 740 is generally aligned with a horizontal surface, the bore 734 may be oriented relative to a vertical direction by the angle 742.

In the example of FIGS. 23-29, the depth of the adjustment recesses 712, 714, 716 and 718, and the angle of the bottom surfaces 713, 715, 717 and 719 may be configured so that by rotating the insert 707 and selectively placing the projections 730 and 732 in different adjustment recesses 712, 714, 716 and 718, the bore 734 may be oriented relative to vertical direction by the angle 742 or be aligned with the vertical direction, i.e., a neutral angle. According to one example, the bottom surfaces 715 and 719 of the adjustment recesses 714 and 718, respectively may define a plane that is inclined relative to the bottom surface 710 by the angle 742. The direction of the inclination of the adjustment recesses 714 and 718 may be from the adjustment recess 718 toward the adjustment recess 714. Accordingly the adjustment recess 714 may be deeper than the adjustment recess 718, yet having the same inclination angle 742. The insert 707 may be placed in the recess 706 such that the projection 732 is placed in the adjustment recess 714 and projection 730 is placed in the adjustment recess 718. The inclination of the projections 730 and 732 complement the inclination of the bottom surfaces 715 and 719, respectively, to align the bore 734 with the vertical direction, which in the examples of FIGS. 23-29, is aligned with the passage 705 and may represent a loft angle of 0° for the face of the golf club head. The bolt 736 may be inserted into the bore 734 to extend through the passage 705 and engage in the hosel section 409. Tightening the bolt 736 secures the hosel section 409 to the golf club head 400. Thus, the golf club head 400 can be secured to the hosel section 409 at the neutral loft angle setting or a loft angle of 0°.

The bottom surfaces 713 and 717 of the adjustment recesses 712 and 716, respectively may define a plane that may be flat relative to the bottom surface 710. The insert 707 may be placed in the recess 706 such that the projection 732 is placed in the adjustment recess 712 and projection 730 is placed in the adjustment recess 716. The inclination of the projections 730 and 732 align the bore 734 at the angle 742 relative to the vertical direction, which in the examples of FIGS. 23-29, may represent a negative loft angle 742 for the face of the golf club head. The bolt 736 may be inserted into the bore 734 to extend through the passage 705 and engage in the hosel section 409. Tightening the bolt 736 secures the hosel section 409 to the golf club head 400. Thus, the golf club head 400 can be secured to the hosel section 409 at a negative loft angle setting or a negative angle 742.

The insert 707 may be placed in the recess 706 such that the projection 730 is placed in the adjustment recess 712 and projection 732 is placed in the adjustment recess 716. The inclination of the projections 730 and 732 align the bore 734 at the angle 742 relative to the vertical direction, which in the examples of FIGS. 23-29, may represent a positive loft angle 742 for the face of the golf club head. The bolt 736 may be inserted into the bore 734 to extend through the passage 705 and engage in the hosel section 409. Tightening the bolt 736 secures the hosel section 409 to the golf club head 400. Thus, the golf club head 400 can be secured to the hosel section 409 at a positive loft angle setting or a positive angle 742.

Figure 27:
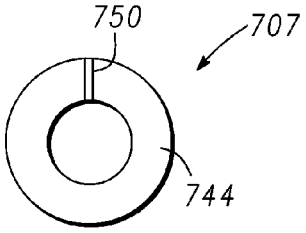
FIGS. 27-29 show schematic diagrams of three loft angle adjustments for the golf club of FIG. 23.
Figure 28:
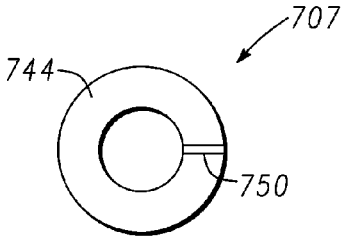
Figure 29:
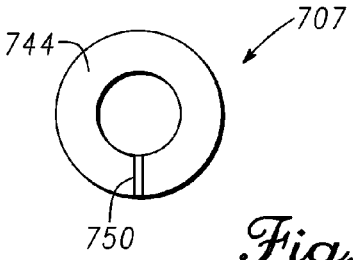

The angle 742 may be any angle such as 5°, 2° or 1°. The angle 742 represents an angle increment by which the loft angel of the golf club head may be varied from a head loft angle, which is defined as a neutral loft angle of a club head or a standard loft angle setting for the golf club head. The head loft angle may be any angle such as 3°. For example, when the angle 742 is 2° and the head loft angle is 0°, rotating the insert 707 and placing the insert 707 in the recess 706 in different positions as described above provides loft angle settings of 2°, 0°, and −2°. In another example, when the angle 742 is 2° and the head loft angle is 3°, rotating the insert 707 and placing the insert 707 in the recess 706 in different positions as described above provides loft angle settings of 5°, 3°, and 1°. Referring to FIGS. 27-29, to provide an individual with an indication of the position of the insert 707 in the recess 706, which may be indicative of a certain loft angle of the golf club head, the main body 744 of the insert 707 may have an indicator such as a line, slot, a depression, a shape or any type of visual indicator that may indicate to an individual the rotational position of the insert 707. In the examples of FIGS. 27-29, the indicator is a line 750 that may be formed on the main body 744, painted or printed on the insert 707, or provided on the insert 707 with a sticker. For example, when the angle 742 is 2° and the head loft angle is 0°, position of the line 750 of FIG. 27 corresponds to a loft angle of −2°. Position of the line 750 of FIG. 28 corresponds to a loft angle of 0°, or a neutral loft angle. Position of the line 750 of FIG. 29 corresponds to a loft angle of 2°. The sole 504 may include numerical indicators such as −2°, 0° and 2° (not shown) to indicate to an individual the loft angle of the golf club head when the line 750 is aligned with the corresponding numerical indicator. In another example, when the angle 742 is 2° and the head loft angle is 3°, position of the line 750 of FIG. 27 corresponds to a loft angle of 1°. Position of the line 750 of FIG. 28 corresponds to a loft angle of 3°, or a neutral loft angle of 3°. Position of the line 750 of FIG. 29 corresponds to a loft angle of 5°. The sole 504 may include numerical indicators such as 1°, 3° and 5° (not shown) to indicate to an individual the loft angle of the golf club head when the line 750 is aligned with the corresponding numerical indicator. The indicators may not indicate numerical angle settings. The indicators may indicate a change in the loft angle setting. For example, the indicators may include a negative sign, a zero and a positive sign to indicate three different loft angle settings. Thus, an individual may change the loft angle of the golf club head by loosening the bolt 736, lifting the insert 707 sufficiently out of the recess 706 so that the projections 730 and 732 are removed from the adjustment recesses, rotating the insert 707 to position the line 750 at a preferred loft angle indicator as shown in FIGS. 27-29, inserting the insert 707 into the corresponding adjustment recesses, and securing the bolt 736 to the hosel section 409.

As disclosed with reference to FIGS. 13 and 21, the hosel 405 may be rotatable about an axis 453 as also shown in FIG. 23 for adjusting a lie angle of the head 402 relative to the shaft. The head 402 may include a bore (not shown) at a front portion of the head 402 and/or a back portion of the head 402 for receiving a pin (not shown). The pin and the bore may define the axis 453. Adjusting the lie angle of the head 402 is similar to the loft angle adjustment described above.

The loft angle and lie angle adjustment mechanism of FIGS. 23-29 provides one example according to the disclosure. In other examples, the recess 706 may include a plurality of adjustment recesses such as six or eight adjustment recesses, where each pair of opposing adjustment recesses may correspond to a certain loft angle of the golf club head. Accordingly, the insert 707 may include two projections as disclosed or a plurality of projections that engage the adjustment recesses to provide adjustment of the loft angle or the lie angle of the golf club head. For example, the recess 706 may include eight adjustment recesses that allow an individual to change the loft angle or the lie angle of the golf club head between seven loft angle settings, which may be −3°, −2°, −1°, 0°, 1°, 2°, and 3°. The insert 707 may include a plurality of projections, or the two exemplary projections 730 and 732 as shown in FIG. 25. The angle 742 of the plane defined by the projections of the insert 707 may be 1° relative to the main body 744 of the insert 707. Accordingly, rotation of the insert 707 and placement thereof in the recess 706 to engage the eight adjustment recesses provides the noted loft angle settings between −3° and 3° at 1° increments. Thus, the insert 707, the number and configurations of the projections on the insert 707, the configuration of the recess 706, the number and configurations of the adjustment recesses in the recess 706, and the number of loft angle settings of the golf club head are not limited to the disclosed examples.

Although a particular order of actions is described above, these actions may be performed in other temporal sequences. For example, two or more actions described above may be performed sequentially, concurrently, or simultaneously. Alternatively, two or more actions may be performed in reversed order. Further, one or more actions described above may not be performed at all. Further, any one or more embodiments or examples described herein may be used in partly or wholly in combination. The apparatus, methods, and articles of manufacture described herein are not limited in this regard.

Although certain example methods, apparatus, systems, and articles of manufacture have been described herein, the scope of coverage of this disclosure is not limited thereto. On the contrary, this disclosure covers all methods, apparatus, systems, and articles of manufacture fairly falling within the scope of the appended claims either literally or under the doctrine of equivalents.

What is claimed is:

1. A golf club head comprising:

a body having a top rail portion, a sole portion, and a recess portion extending between the top rail portion and the sole portion;

a hosel comprising a first end configured to rotationally connect to the body and a second end configured to receive a shaft, wherein the body further comprises a slot configured to receive the first end of the hosel, wherein the hosel is connected in the slot with at least one pin extending through the body and engaged in a bore in the hosel, and wherein the bore in the hosel defines an axis of rotation of the hosel relative to the body; and an insert configured to be inserted in the recess portion and coupled to the first end of the hosel, the insert configured to be positioned in the recess portion at one rotational position of a plurality of different rotational positions corresponding to a plurality of different angles between the body and the shaft.

2. The golf club head of claim 1, wherein the plurality of different angles between the body and the shaft comprises a plurality of different loft angles between the body and the shaft.

3. The golf club head of claim 1, wherein the plurality of different angles between the body and the shaft comprises a plurality of different lie angles between the body and the shaft.

4. The golf club head of claim 1, wherein the insert is configured to be coupled to the first end of the hosel, and wherein the second end of the hosel and the shaft are rotationally connected to provide an adjustable angle between the hosel and the shaft.

5. The golf club head of claim 1, wherein the insert comprises a plurality of projections and the recess comprises a plurality of adjustment recesses, wherein engagement of the projections with a selected plurality of adjustment recesses of the plurality of adjustment recesses provides an angle between the body and the shaft corresponding to the selected plurality of adjustment recesses.

6. The golf club head of claim 1, wherein the first end of the hosel comprises a threaded bore configured to receive a bolt, wherein the insert comprises a hole, and wherein at each of the plurality of rotational positions of the insert, the hole is alignable at a different angle with the threaded bore to provide engagement of the bolt through the hole and with the threaded bore.

7. The golf club head of claim 1, wherein the insert comprises a first rotational position corresponding to a negative angle between the body and the shaft, a second rotational position corresponding to a neutral angle between the body and the shaft, and a third rotational position corresponding to a positive angle between the body and the shaft.

8. The golf club head of claim 1, wherein the first end of the hosel comprises a threaded bore configured to receive a bolt inserted from the sole portion through the insert to fix the body relative to the shaft at the one rotational position.

* * * * *